US005102249A

United States Patent [19]

Holloway et al.

[11] Patent Number: 5,102,249

[45] Date of Patent: Apr. 7, 1992

[54] LIPSTICK DISPENSER FOR SHAPED POMADES

[75] Inventors: Thomas F. Holloway, Southbury; Walter Ackermann, Watertown; James Bigham, New Fairfield; Edward Wittman, Brookfield, all of Conn.

[73] Assignee: Risdon Corporation, Naugatuck, Conn.

[21] Appl. No.: 673,327

[22] Filed: Mar. 22, 1991

[51] Int. Cl.[5] ..... B43K 21/08

[52] U.S. Cl. ..... 401/78; 401/116; 401/172; 401/69

[58] Field of Search ..... 401/69, 75–78, 401/81, 116, 172

[56] References Cited

U.S. PATENT DOCUMENTS

| | | | |
|---|---|---|---|
| 2,340,556 | 2/1944 | Picinich | 401/78 |
| 2,491,721 | 12/1949 | Gelardin | 401/81 X |
| 2,491,722 | 12/1949 | Gelardin | 401/81 X |
| 2,655,261 | 10/1953 | Clark | 401/81 X |
| 2,797,802 | 7/1957 | Hopgood | 206/56 |
| 2,815,123 | 12/1957 | Safianoff | 401/78 X |
| 2,838,170 | 6/1958 | Isele | 206/56 |
| 2,840,229 | 6/1958 | Hopgood | 206/56 |
| 3,091,329 | 5/1963 | Levine | 206/56 |
| 3,256,980 | 6/1966 | Bau | 206/56 |
| 3,298,509 | 1/1967 | Hultgren | 206/56 |
| 3,789,857 | 2/1974 | Ikeda et al. | 401/78 X |
| 4,514,102 | 4/1985 | Ackerman et al. | 401/78 |
| 4,603,989 | 8/1986 | Ackerman et al. | 401/78 |
| 4,750,501 | 6/1988 | Ackermann et al. | 132/79 C |
| 4,770,556 | 9/1988 | Ackermann et al. | 401/69 |

FOREIGN PATENT DOCUMENTS

| | | | |
|---|---|---|---|
| 335798 | 4/1921 | Fed. Rep. of Germany | 401/116 |
| 463766 | 7/1928 | Fed. Rep. of Germany | 401/75 |
| 2040041 | 2/1972 | Fed. Rep. of Germany | 401/75 |
| 210681 | 2/1924 | United Kingdom | 401/81 |
| 710934 | 6/1954 | United Kingdom | |

*Primary Examiner*—Danton D. DeMille

*Attorney, Agent, or Firm*—St. Onge Steward Johnston & Reens

[57] ABSTRACT

A lipstick dispenser having a propel/retract mechanism that permits shaped pomades and shaped outer casings, without requiring excessive length to accommodate the mechanism, comprises a base, a helical spring affixed to and extending from the base, a sleeve fitted over the helical spring and having an engaged end which is rotably affixed to the base, and an elevator cup fitted into the sleeve and having an extending stem with a threaded portion for engaging with the helical spring. Relative rotation of the spring and the threaded portion caused by rotation of the base and sleeve causes axial movement of the elevator cup. During retraction of the elevator cup, the spring accumulates and is compressed in the zone of the stem between the cup and the threaded portion of the elevator cup.

21 Claims, 2 Drawing Sheets

LIPSTICK DISPENSER FOR SHAPED POMADES

FIELD OF THE INVENTION

The present invention relates to the field of cosmetic and lipstick dispensers, and particularly to a dispenser useful with a shaped cosmetic pomade.

BACKGROUND OF THE INVENTION

Conventional propel/repel lipstick dispensers having an outer helical cam track sleeve and a longitudinal track innerbody rotatable inside the cam sleeve to axially propel and retract an elevator cup with a lug that tracks in the cam and longitudinal tracks are known and are disclosed, for example, in Hultgren, U.S. Pat. No. 3,298,509. The disadvantage of such conventional dispensers are only operable when the cam sleeve has a circular cross-section. Thus the innerbody, elevator cup, and the cosmetic pomade carried in the elevator cup both must have a circular cross-section.

Shaped pomades have been known, and have heretofore been usable only in a center screw type dispenser such as shown in Bau, U.S. Pat. No. 3,256,980. The disadvantage of such designs is that the dispenser must be sufficiently long to enclose the entire length of both the center screw mechanism and the lipstick pomade when the lipstick is retracted. Thus, to contain the same length of shaped pomade as in a circular pomade in a cam sleeve type dispenser, the dispenser of the center screw type would be about twice as long as a cam sleeve type dispenser. Consequently, a compact dispenser is not feasible without a reduction in pomade quantity from a conventional lipstick pomade. It is to be appreciated that consumers do not appreciate such a reduction of product size, and accordingly, a shaped pomade in a compact dispenser has not been commercially feasible.

SUMMARY OF THE INVENTION

It is an object of the invention to provide a dispenser having a mechanism that permits the use of shaped outer sleeves and shaped pomades while requiring a dispenser length which is substantially less than required for a center screw mechanism. It is a further object of the invention to provide a dispenser with a propel/retract mechanism that compresses and shortens during retraction, permitting a reduced length of any outer casing for the dispenser. It is a further object of the invention to provide such a dispenser which in operation has a luxurious feel provided by a sufficient frictional swivel torque.

In accordance with one embodiment of the invention, a dispenser comprises a base, a helical spring affixed to and extending from the base, a sleeve fitted over the helical spring and having a longitudinal track in an inner wall thereof and having an engaged end which is rotably affixed to the base, and an elevator cup fitted into the sleeve. The elevator cup has a cup end for containing a cosmetic, and a stem end having a threaded portion for engaging with the helical spring, and a lug for seating in the longitudinal track of the sleeve. The elevator cup is axially movable in the sleeve by the relative rotation of the sleeve and the base, which rotation causes relative rotation of the spring and the threaded portion of the elevator cup which are engaged together so that the elevator cup moves axially to propel the elevator cup to an extended position and to retract the elevator cup to a retracted position. During retraction of the elevator cup, the spring accumulates and is compressed in a zone between the cup base and the threaded portion of the elevator cup. Since this drive mechanism is not dependent on the interaction of a cam track sleeve with the lug of the elevator cup, the invention permits various elements of the outer walls, sleeve, base, elevator cup and cosmetic pomade to have cross-sectional shapes which are non-circular. Further, since the spring compresses and is stored during retraction of the elevator cup, the overall length of the dispenser may be shorter than where a rigid screw mechanism is used. This also permits an aesthetically pleasing cap/body proportion, since the sleeve need not have the same length as the base.

The spring is sufficiently stiff such that user of the dispenser will not discern excessive give when using the dispenser. In addition, to assure a sufficient and desirable swivel torque feel, the pitches of the spring and of the interengaged threaded portion of the elevator cup stem end are selected to provide a relatively high drag. Preferably, the ratio of the pitch of the threaded portion to the pitch of the helical spring is between about 0.51 to about 0.65, and most preferably it is about 0.59. In one preferred embodiment, the threaded portion has a pitch of about 0.11 inch and the helical spring has a pitch of about 0.187 inch.

A cap will be provided with the dispenser to fit over the sleeve and frictionally mount on the base. For decorative enhancement, the sleeve, base, and cap may all have brass shells fitted over and mounted thereon.

Other objects, aspects and features of the present invention in addition to those mentioned above will be pointed out in or will be understood from the following detailed description provided in conjunction with the accompanying drawings.

DETAILED DESCRIPTION OF THE PREFERRED EMBODIMENT

Figure 1:
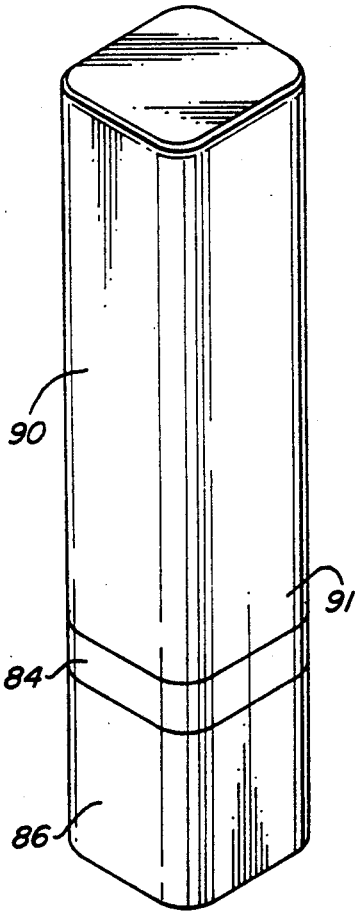
FIG. 1 is a perspective view of an embodiment of an assembled and capped dispenser in accordance with the invention.
Figure 2:
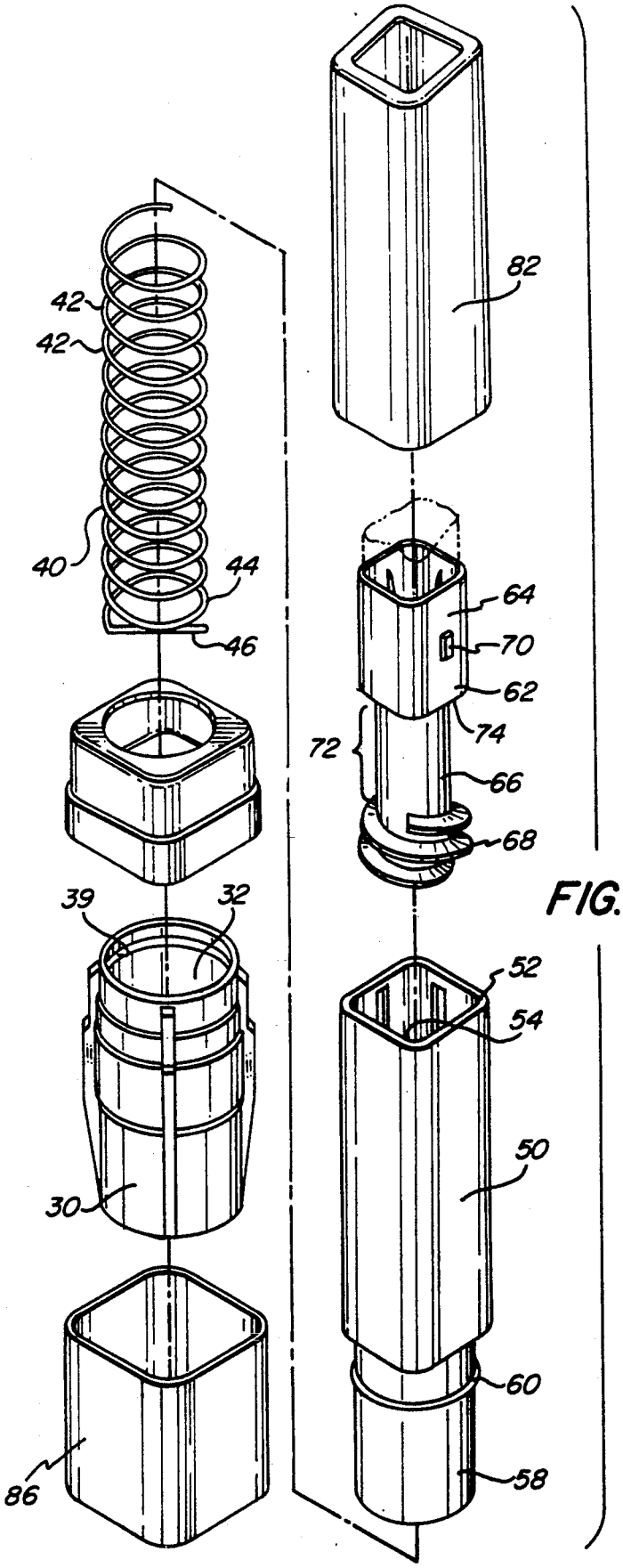
FIG. 2 is an exploded view of the components of an embodiment of a dispenser in accordance with the invention.

Referring now to FIGS. 1–4, a lipstick dispenser for shaped pomades is shown generally at 20. Dispenser 20 comprises a base 30, a spring 40, a sleeve 50 and an elevator cup 62.

Base 30 has a base chamber 32 which is generally cylindrical. Base 30 is provided with clipping formation 34 at the lower floor of base chamber 32. Clipping formation 34 preferably comprises two opposed hooks 36 made of a resilient material and adapted to receive and hold a wire. Base 30 is preferably also provided with a stop strut 38 for stopping retraction of the elevator cup 62, as will be set forth in greater detail subsequently.

Spring 40 is a helical spring formed of stainless steel. Spring 40 is uniform in width and size and comprises a plurality of coils 42. Spring 40 in its lower end 44 is provided with an end portion 46 that traverses the center bore of the spring 40. End portion 46 is located to be snapped into and retained in the clipping formation 34. Lower end 44 thus is fitted into the base chamber 32.

Sleeve 50 has an open extending end 52, and an inner chamber 54. At least one longitudinal track 56 is formed in the inner wall of inner chamber 54. Preferably there are two such longitudinal tracks located at opposite sides of the inner chamber 54. Sleeve 50 has an engaged end 58 which is rotably affixed to the base 30, such that the sleeve 50 may be rotated relative to the base 30 without separation therefrom. The sleeve 50 and base 30 are preferably secured together by an interfitting combination of a rib and channel for receiving said rib. In the preferred embodiment, an annular rib 60 is formed on the engaged end 58 of the sleeve 50, which rib 60 snap fits into a corresponding annular channel 39 provided in base 30. Alternatively, the base 30 may be provided with an annular rib and the sleeve 50 may be provided with a corresponding annular channel.

It is to be appreciated, that while circular cross-sectional elements are necessary to rotably mate the base 30 and the sleeve 50, that otherwise the sleeve 50 may have any desired cross-sectional shape, to accommodate a variety of pomade cross-sectional shapes. In particular, only the engaged end 58 of the sleeve and the inner walls of the base 30 need to be circular in cross-section.

Elevator cup 62 is fitted into the sleeve 50. Cup 62 has a cup end 64 for containing a cosmetic, and a stem end 66 having a threaded portion 68 for engaging with the helical spring 40. The threaded portion 68 preferably comprises two or more thread turns. Cup end 64 extends toward the open end 52 of sleeve 50. Stem end 66 extends toward the base chamber 32. The threaded portion 68 is separated from the cup end 64 by a sufficient distance to permit the accumulation and storage of the other operable part of the retraction mechanism, namely the helical spring 40, as set forth herein.

Cup 62 has a lug 70 for seating in the longitudinal track 56 of sleeve 50. Where there are two such tracks 56, there are two such lugs 70 for fitting into such tracks 56.

The cup end 64 has a larger cross-section than the cross-section of the stem end 66. The cup end 64 preferably fits snugly in the sleeve 50 such that it can slide freely without excessive lateral play. In addition, the spring 40 preferably has a diameter which is less than the cross-sectional width of the cup end 64 but which is slightly larger than the unthreaded portions of the stem end 66, so that the spring will collect and store on the stem end as set forth herein.

Figure 3:
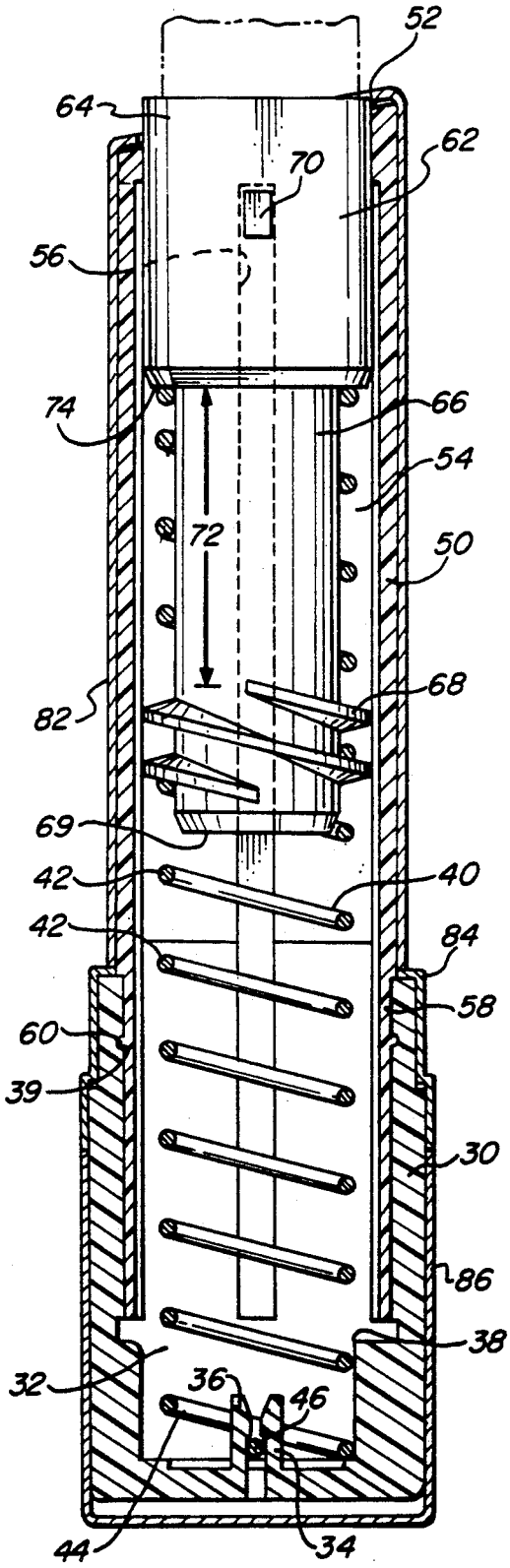
FIG. 3 is a cross-sectional view of an embodiment of a dispenser in accordance with the invention in the extended dispensing position.

The elevator cup 62 is axially movable in the sleeve 50 by the relative rotation of the sleeve 50 and the base 30. This rotation causes relative rotation of the spring 40 and the threaded portion 68 of the stem end 66 of the cup 62. The threaded portion 68 of cup 62 is engaged in the coils 42 of the helical spring 40. Thus the relative rotation of the cup 62 and the coils 42 causes the cup 62 to move axially to propel the elevator cup to an extended position as shown in FIG. 3 and to retract the elevator cup to a retracted position as shown in FIG. 4.

Preferably the threading on the threaded portion 68 is left hand threaded, as are the coils 42 of spring 40, so that the counterclockwise rotation of base 30 relative to sleeve 50 causes elevator cup 62 to retract, while the clockwise rotation of base 30 relative to sleeve 50 causes elevator cup 62 to propel to an extended position.

Figure 4:
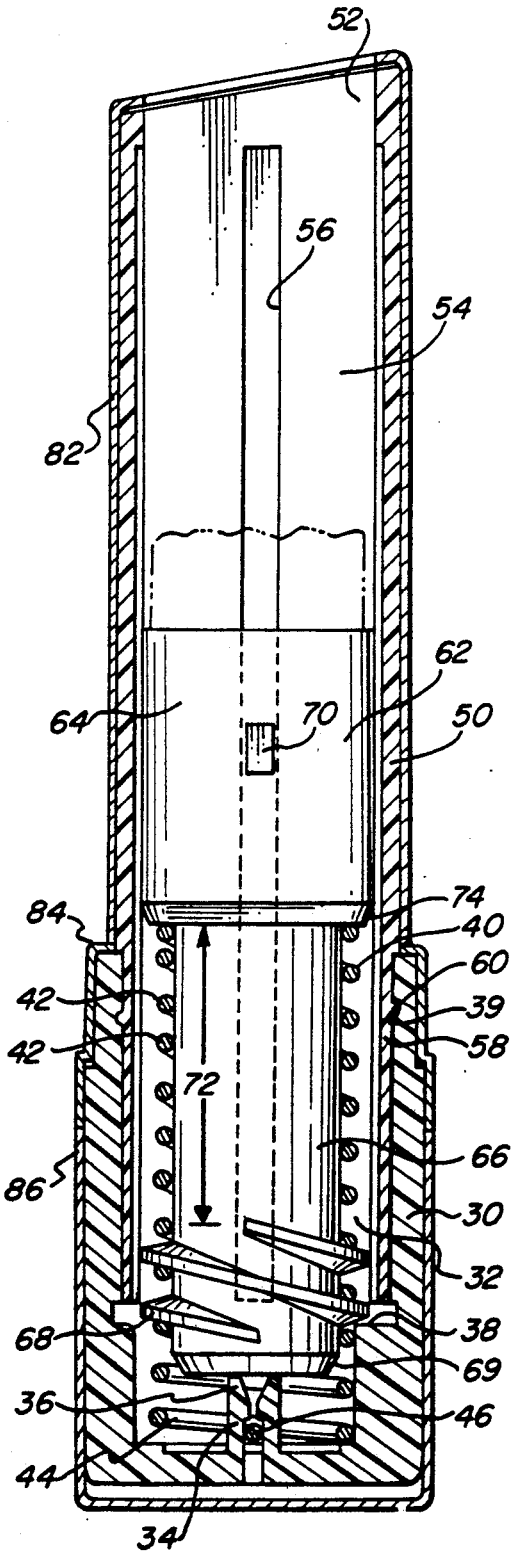
FIG. 4 is a cross-sectional view of the dispenser of FIG. 3 in the retracted position.

During retraction of the elevator cup, as shown in FIG. 4, the spring 40 accumulates and is compressed in an annular zone 72 between the floor 74 of the cup end 64 and the threaded portion 68 of the elevator cup 72. The retraction is stopped by the stop strut 38 when the threaded portion 68 is sufficiently retracted to abut the stop strut 38. In addition, the lower end 69 of cup stem 66 will butt against clipping formation 34 to stop the retraction.

The spring 40 is sufficiently stiff such that user of the dispenser 20 will not discern excessive give when pushing on the cup 62 while using the dispenser 20. In addition, to assure a consistent and sufficient swivel torque feel, the pitch of the spring 40 and of the interengaging threaded portion 68 of the elevator cup 62 are selected to provide a relatively high drag to give the desired feel. Preferably, the ratio of the pitch of the threaded portion 68 to the pitch of the helical spring 40 is between about 0.51 to about 0.65, and most preferably it is about 0.59. Other pitch ratios may be selected by the practitioner depending on the desired feel. In one preferred embodiment, the threaded portion 68 has a pitch of about 0.11 inch and the helical spring 40 has a pitch of about 0.187 inch.

A cap 90 is provided with the dispenser 20. Cap 90 has a lower end 91 suited for fitting over the sleeve 50 and frictionally mounts on the base 30. For decorative enhancement, the sleeve 50, base 30, and cap 90 may all have brass shells fitted over them. For example, in FIGS. 1–4, a sleeve shell 82 fits over sleeve 50, a collar shell 84 fits over the upper end of base 30, a base shell 86 fits over the lower end of base 30, and a cap shell fits over the cap 90. These decorative shells 82, 84 and 86 may be affixed to their respective underlying structural components by gluing and/or by forming their ends to clip onto the ends of the sleeve 50, base 30 and cap 90 respectively.

The drive mechanism described above is not dependent on the circular configuration of the sleeve of the dispenser needed to provide a cam track. Therefore, the sleeve, elevator cup and cosmetic pomade may have cross-sectional shapes which are non-circular. Further, since the spring 40 compresses and is stored during retraction of the elevator cup 62, the overall length of the dispenser 20 may be shorter than if a rigid screw mechanism were used. The present invention thus provides a novel cosmetic dispenser suitable for use with shaped pomades.

It is to be appreciated that the foregoing is illustrative and not limiting of the invention, and that the practitioner may also develop other embodiments all within the scope of the invention.

We claim:

1. A cosmetic dispenser, comprising:

base means having a base chamber;

a helical spring affixed to said base means and extending from said base chamber, said helical spring having a plurality of coils;

sleeve means fitted over said helical spring, said sleeve means having an open extending end, and an inner chamber, and at least one longitudinal track in an inner wall thereof, and having an engaged end which is rotably affixed to said base means whereby said sleeve means may be rotated relative to said base means without separation therefrom;

an elevator cup having a cup end and a stem end, said elevator cup being fitted into said inner chamber of said sleeve means, said stem end extending towards said base means and having a threaded portion sized and oriented to engage with said coils of said helical spring, said cup end extending towards said open end of said sleeve means; said elevator cup having at least one lug sized and extending outwardly therefrom for seating and tracking in said longitudinal track of said sleeve means; said elevator cup being axially movable in said sleeve means by the relative rotation of said sleeve means and said base means, said rotation causing relative rotation of said spring and said threaded portion whereby said threaded portion engaged in said coils of said helical spring moves axially to propel said elevator cup to an extended position and to retract said elevator cup to a retracted position in said sleeve means; and said helical spring being substantially stiff such that said elevator cup is biased against movement of said cup into said sleeve and also having sufficient resilience whereby said spring may be compressed and stored between said elevator cup and said threaded portion of said elevator cup when said cup is in said retracted position.

2. A cosmetic dispenser in accordance with claim 1, wherein said elevator cup stem end threaded portion comprises two or more thread turns.

3. A cosmetic dispenser in accordance with claim 1, wherein said base means and sleeve means are affixed together by the interengagement of an annular rib on one of said base and sleeve means with an annular channel on the other of said base and sleeve means.

4. A cosmetic dispenser in accordance with claim 1 further comprising a cap for fitting over and enclosing said sleeve means, said cap having an open end which is frictionally mountable on a portion of said base means.

5. A cosmetic dispenser in accordance with claim 4 further comprising:

a brass shell fitted over and mounted on said cap.

6. A cosmetic dispenser in accordance with claim 1 further comprising a stop strut formed with said base means and extending a sufficient distance from a lower floor of said base chamber whereby said elevator cup stem end abuts said stop strut when said elevator cup is retracted into said sleeve means.

7. A cosmetic dispenser in accordance with claim 1 wherein said helical spring is affixed to said base means by a clip means located in said base means and engaging an end portion of said helical spring which traverses a center bore of said helical spring.

8. A cosmetic dispenser in accordance with claim 1 wherein said threaded portion comprises a left hand thread.

9. A cosmetic dispenser in accordance with claim 1 wherein said threaded portion has a pitch of about 0.11 inch.

10. A cosmetic dispenser in accordance with claim 9 wherein the coils of said helical spring have a pitch of about 0.187 inch.

11. A cosmetic dispenser in accordance with claim 1 wherein said threaded portion has a pitch, and wherein said helical spring has a pitch, and wherein the ratio of the pitch of the threaded portion to the pitch of the helical spring is between about 0.51 to about 0.65.

12. A cosmetic dispenser in accordance with claim 1 wherein said threaded portion has a pitch, and wherein said helical spring has a pitch, and wherein the ratio of the pitch of the threaded portion to the pitch of the helical spring is about 0.59.

13. A cosmetic dispenser in accordance with claim 1 further comprising:

a brass shell fitted over and mounted on said base means; and a brass shell fitted over and mounted on said sleeve means.

14. A cosmetic dispenser, comprising:

base having a base chamber, and being provided with an annular channel on an inner wall of said base, said inner wall being circular in cross-section;

a helical spring affixed to said base and extending from said base chamber, said helical spring having a plurality of coils;

a sleeve fitted over said helical spring, said sleeve having an open extending end having an inwardly directed lip defining an aperture, and an inner chamber, and at least one longitudinal track in an inner wall thereof, and having an engaged end which is circular in cross-section and fitted into and located against said inner walls of said base chamber, said engaged end having an annular rib corresponding to and fitted into said annular channel of said base, whereby said sleeve and base are rotably affixed to each other;

an elevator cup having a cup end and a stem end, said elevator cup being fitted into said chamber of said sleeve such that said helical spring is trapped in said sleeve, said stem end extending towards said base and having a left hand threaded portion comprising thread turns sized and oriented to engage with said coils of said helical spring, said cup end extending towards said open end of said sleeve; said elevator cup end being sized and shaped to pass through said aperture in said extending end; said elevator cup having at least one lug sized and extending outwardly therefrom for seating and tracking in said longitudinal track of said sleeve; said elevator cup being axially movable in said sleeve by the relative rotation of said sleeve and said base, said rotation causing relative rotation of said spring and threaded portion whereby said threaded portion engaged in said coils of said spring moves axially to propel said elevator cup to an extended position, and to retract said elevator cup to a retracted position in said sleeve.

15. A cosmetic dispenser in accordance with claim 14 wherein said helical spring is substantially stiff such that said elevator cup is biased against movement of said cup into said sleeve, yet is sufficiently resilient such that said spring may be compressed and stored between said elevator cup and said threaded portion of said elevator cup when said cup is in a retracted position.

16. A cosmetic dispenser in accordance with claim 15 wherein said threaded portion has a pitch of about 0.11 inch.

17. A cosmetic dispenser in accordance with claim 16 wherein said helical spring has a pitch of about 0.187 inch.

18. A cosmetic dispenser in accordance with claim 15 wherein said threaded portion has a pitch, and wherein said helical spring has a pitch, and wherein the ratio of the pitch of the threaded portion to the pitch of the helical spring is between about 0.51 to about 0.65.

19. A cosmetic dispenser in accordance with claim 18 wherein said threaded portion has a pitch, and wherein said helical spring has a pitch, and wherein the ratio of the pitch of the threaded portion to the pitch of the helical spring is about 0.59.

20. A cosmetic dispenser in accordance with claim 15 further comprising a cap for fitting over and enclosing said sleeve, said cap having an open end which is frictionally mountable on a portion of said base.

21. A cosmetic dispenser in accordance with claim 20 further comprising a decorative shell fitted over and mounted on one or more of said base, sleeve and cap.

* * * * *